US006474230B2

(12) United States Patent
Corrado

(10) Patent No.: US 6,474,230 B2
(45) Date of Patent: Nov. 5, 2002

(54) METALLIC IMAGING SYSTEM

(76) Inventor: Stephen Corrado, 13700 74th Ave., Seminole, FL (US) 33776-3801

( * ) Notice: Subject to any disclaimer, the term of this patent is extended or adjusted under 35 U.S.C. 154(b) by 119 days.

(21) Appl. No.: 09/735,748

(22) Filed: Dec. 13, 2000

(65) Prior Publication Data

US 2002/0069772 A1 Jun. 13, 2002

(51) Int. Cl.[7] ..... B41F 17/00; B31F 1/07; B44B 5/02

(52) U.S. Cl. ..... 101/35; 101/31; 101/9; 101/27

(58) Field of Search ..... 101/35, 31, 399, 101/41, 27, 9

(56) References Cited

U.S. PATENT DOCUMENTS 5,809,876 A * 9/1998 Thompson ..... 101/31

* cited by examiner

*Primary Examiner*—Daniel J. Colilla
*Assistant Examiner*—Marvin P. Crenshaw

(57) ABSTRACT

An imaging system is disclosed. A housing has an interior chamber and a door. A press has a base fabricated of a rigid material and with an upper surface. The press has a raisable platen with a lower surface fabricated of a resilient material. A support plate is positionable on the upper surface of the base for the receipt of an object. A transfer sheet has printing material positioned upon the object. Drive mechanisms urge the platen downwardly into contact with the transfer sheet with the object, plate and base there beneath. Heating components located within the platen generate heat. Cooling components located within the base lower the temperature of the object after the transfer of images.

2 Claims, 4 Drawing Sheets

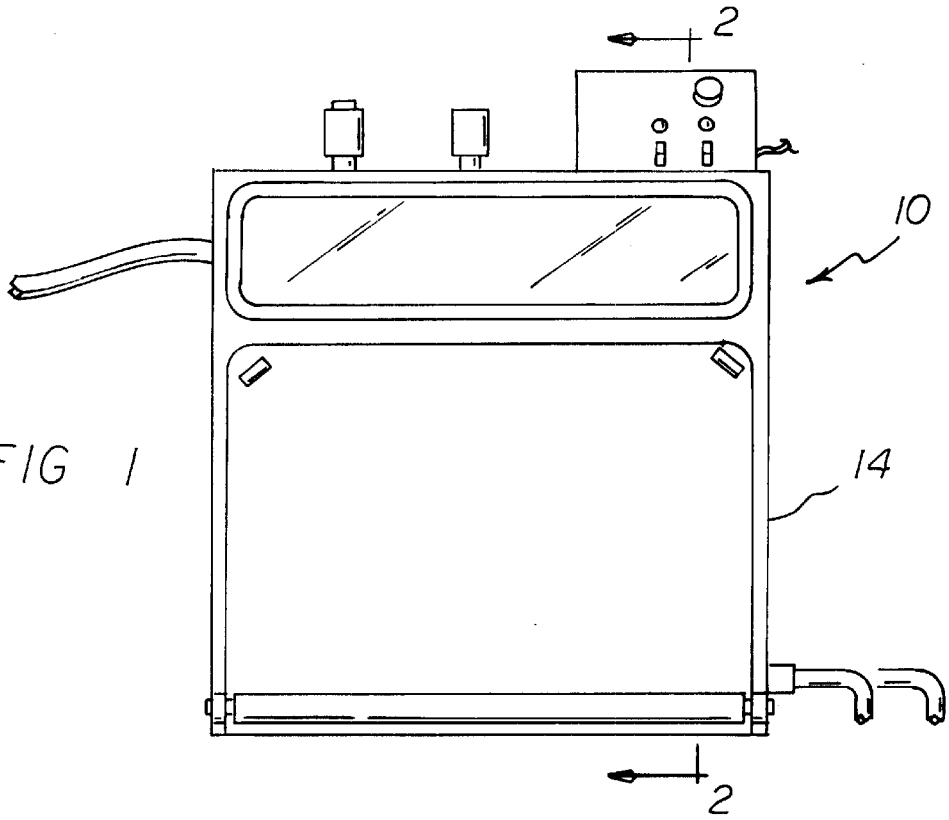
FIG 1
FIG 2
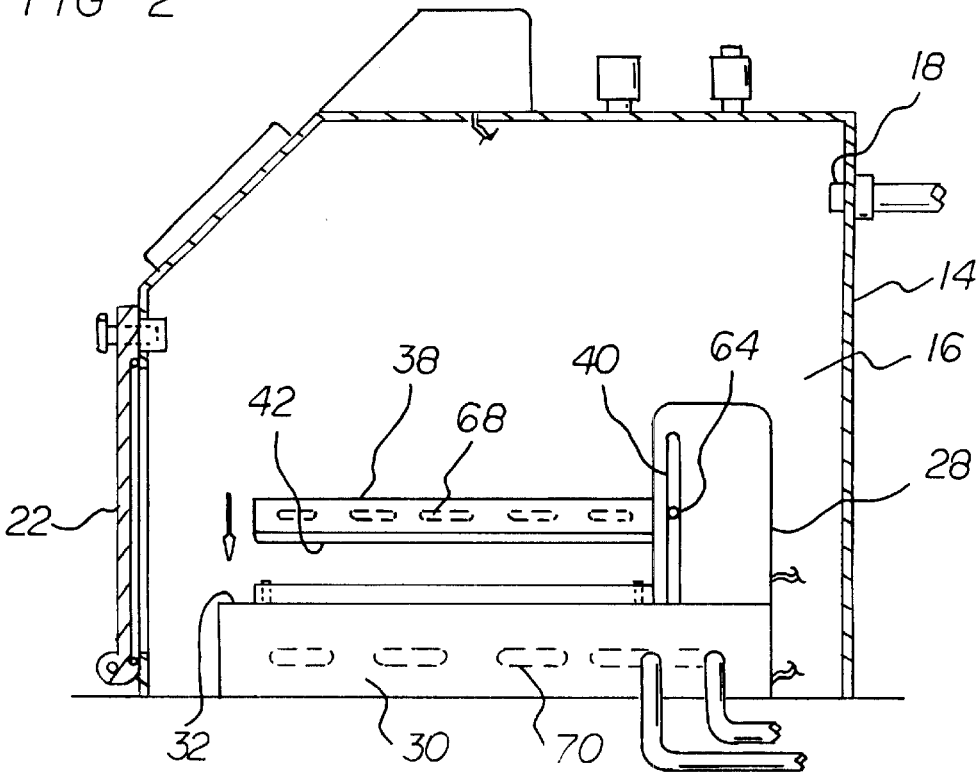

METALLIC IMAGING SYSTEM

BACKGROUND OF THE INVENTION

1. Field of the Invention

The present invention relates to a metallic imaging system and more particularly pertains to permanently affixing a multicolor image to a metallic surface.

2. Description of the Prior Art

The use of imaging systems of known designs and configurations is known in the prior art. More specifically, imaging systems of known designs and configurations previously devised and utilized for the purpose of affixing images to various substrates through known methods and apparatuses are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a metallic imaging system that allows permanently affixing a multicolor image to a metallic surface.

In this respect, the metallic imaging system according to the present invention substantially departs from the conventional concepts and designs of the prior art, and in doing so provides an apparatus primarily developed for the purpose of permanently affixing a multicolor image to a metallic surface.

Therefore, it can be appreciated that there exists a continuing need for a new and improved metallic imaging system which can be used for permanently affixing a multicolor image to a metallic surface. In this regard, the present invention substantially fulfills this need.

SUMMARY OF THE INVENTION

In view of the foregoing disadvantages inherent in the known types of imaging systems of known designs and configurations now present in the prior art, the present invention provides an improved metallic imaging system. As such, the general purpose of the present invention, which will be described subsequently in greater detail, is to provide a new and improved metallic imaging system and method which has all the advantages of the prior art and none of the disadvantages.

To attain this, the present invention essentially comprises a metallic imaging system for permanently affixing a multicolor image to a metallic surface. First provided is a housing. The housing has an interior chamber with an orifice for withdrawing air and contaminants from the chamber. The housing also has a window for viewing. The housing further has a door for introducing metallic objects into the chamber for receiving printed matter and for removing such objects from the chamber after printing. Next provided is a press. The press is positioned within the chamber. The press has a base with a horizontal upper surface in a rectangular configuration. The base is fabricated of a rigid material. The base has an upper surface. The upper surface has a plurality of positioning pins which extend upwardly from the corners of the upper surface. The press also has a raisable platen with a guide for movement of the platen between a raised orientation away from the base for loading and unloading purposes and a horizontal lowered orientation immediately above the base during printing. The platen has a lower surface fabricated of a resilient material which is conformable to metal objects to receive printing when located between the upper surface of the base and the lower surface of the platen. Next provided is a rigid support plate. The rigid support plate is in a rectangular configuration and is positionable on the upper surface of the base. The support plate has apertures in corners thereof for removable coupling with the pins upon the base. The support plate has recesses formed therein for the receipt of a plurality of objects to receive printing thereon. A flexible rectangular transfer sheet is next provided. The transfer sheet has apertures in corners thereof for removable coupling with the pins of the base. The transfer sheet has multicolor printing material in image configuration positioned upon the objects to receive the printing material. Next provided are drive mechanisms. The drive mechanisms function to urge the platen downwardly into contact with the transfer sheet with the objects, plate and base there beneath to effect the transfer of printing material from the transfer sheet to the objects. Heating components are located within the platen. The heating components function to generate heat sufficient to facilitate the complete transfer of transfer material from the transfer sheet to the objects. Lastly provided are cooling components. The cooling components are located within the base for the rapid lowering of temperature of the objects after the transfer of images.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved metallic imaging system which has all of the advantages of the prior art imaging systems of known designs and configurations and none of the disadvantages.

It is another object of the present invention to provide a new and improved metallic imaging system which may be easily and efficiently manufactured and marketed.

It is further object of the present invention to provide a new and improved metallic imaging system which is of durable and reliable constructions.

An even further object of the present invention is to provide a new and improved metallic imaging system which is susceptible of a low cost of manufacture with regard to both materials and labor, and which accordingly is then susceptible of low prices of sale to the consuming public, thereby making such metallic imaging system economically available to the buying public.

Even still another object of the present invention is to provide a metallic imaging system for permanently affixing a multicolor image to a metallic surface.

Lastly, it is an object of the present invention to provide a new and improved imaging system. A housing has an interior chamber and a door. A press has a base fabricated of a rigid material and with an upper surface. The press has a raisable platen with a lower surface fabricated of a resilient material. A support plate is positionable on the upper surface of the base for the receipt of an object. A transfer sheet has printing material positioned upon the object. Drive mechanisms urge the platen downwardly into contact with the transfer sheet with the object, plate and base there beneath. Heating components located within the platen generate heat. Cooling components located within the base lower the temperature of the object after the transfer of images.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is front elevational view of the new and improved metallic imaging system constructed in accordance with the principles of the present invention.

FIG. 2 is a cross sectional view taken along line 2—2 of FIG. 1.

The same reference numerals refer to the same parts throughout the various Figures.

DESCRIPTION OF THE PREFERRED EMBODIMENT

Figure 3:
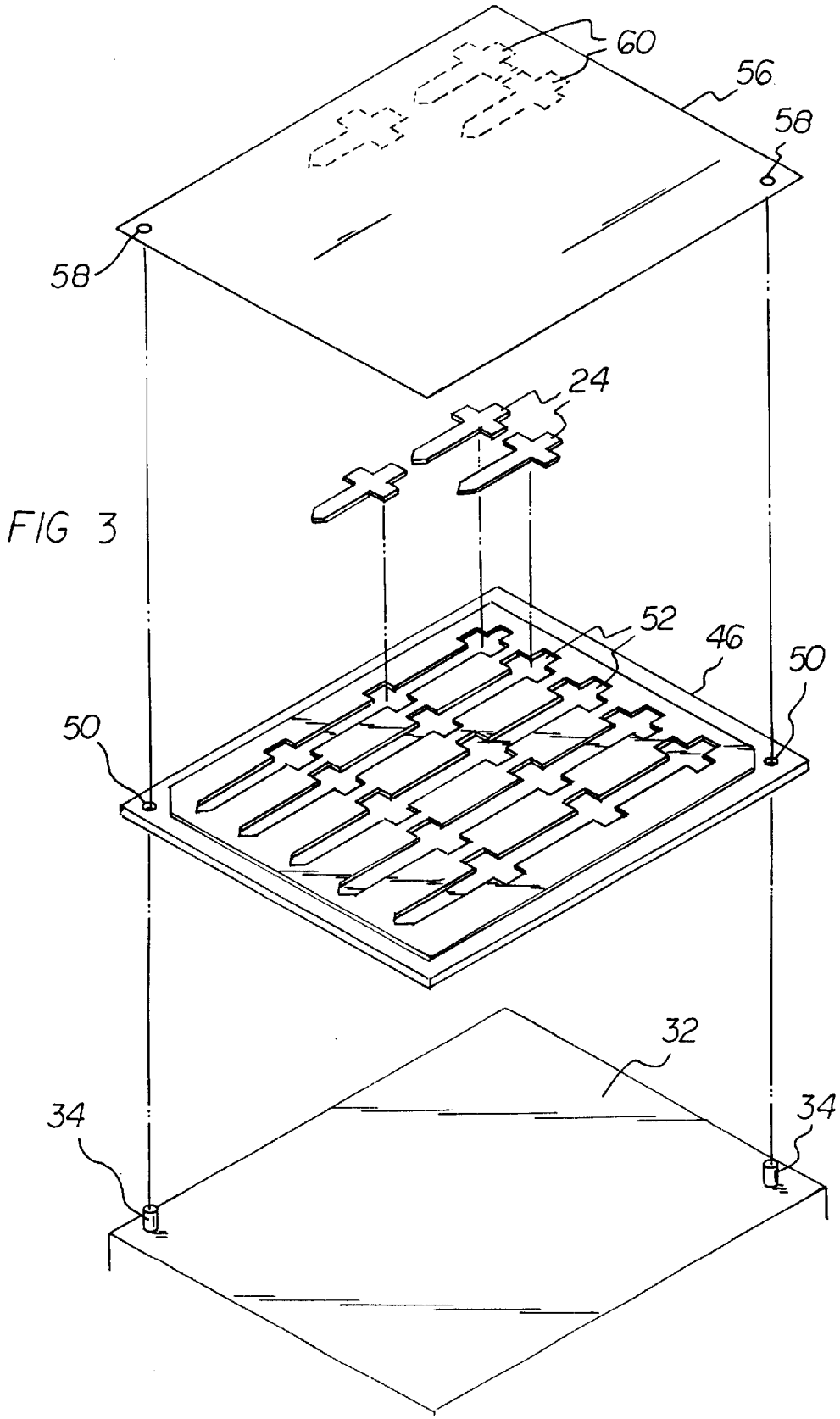
FIG. 3 is an exploded perspective view of the rigid support plate of the press along with objects to receive printing and a transfer sheet there above.
Figure 4:
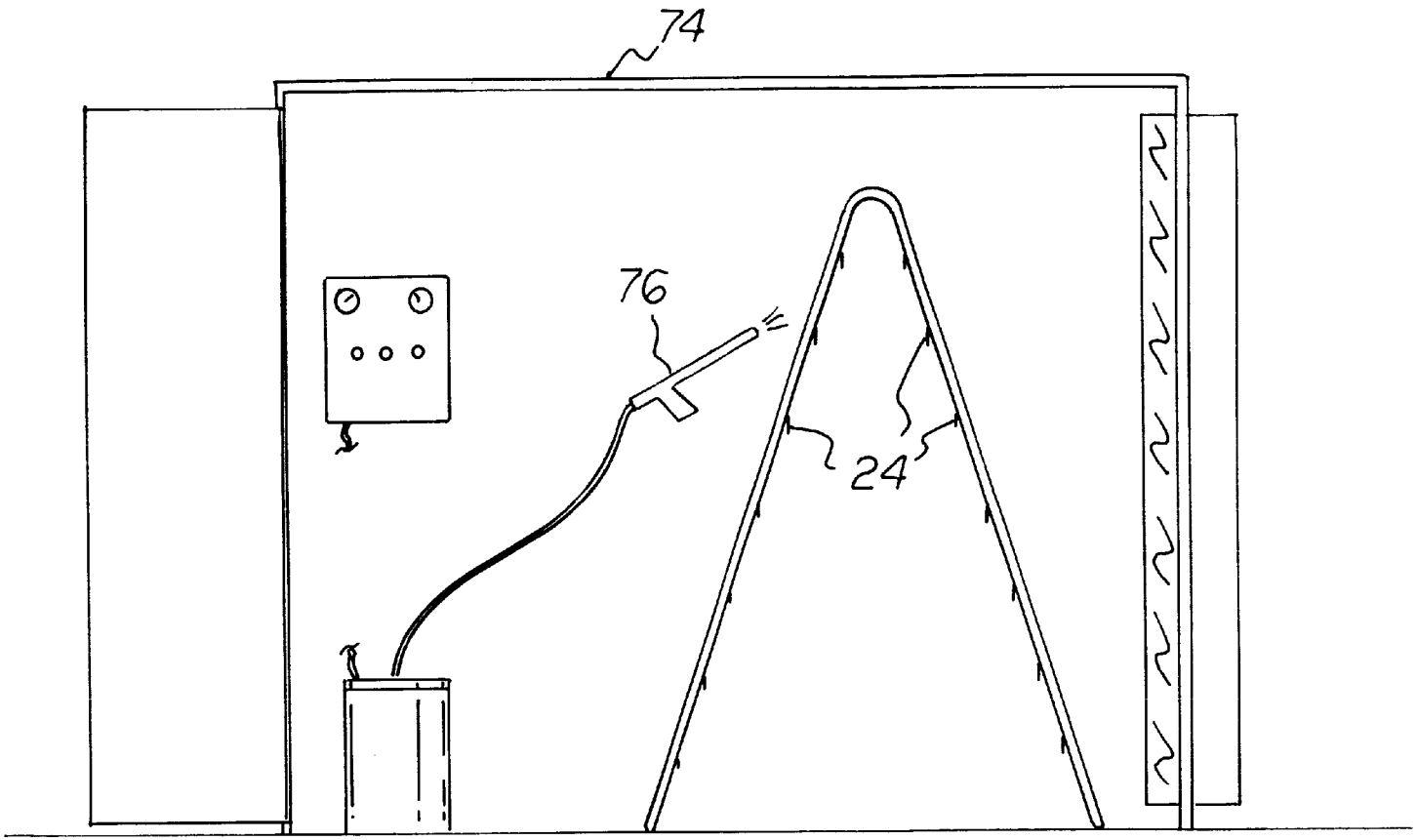
FIG. 4 is a cross sectional view of a spray chamber for finishing the printed metal surfaces constructed in accordance with the princples of the present invention.
Figure 5:
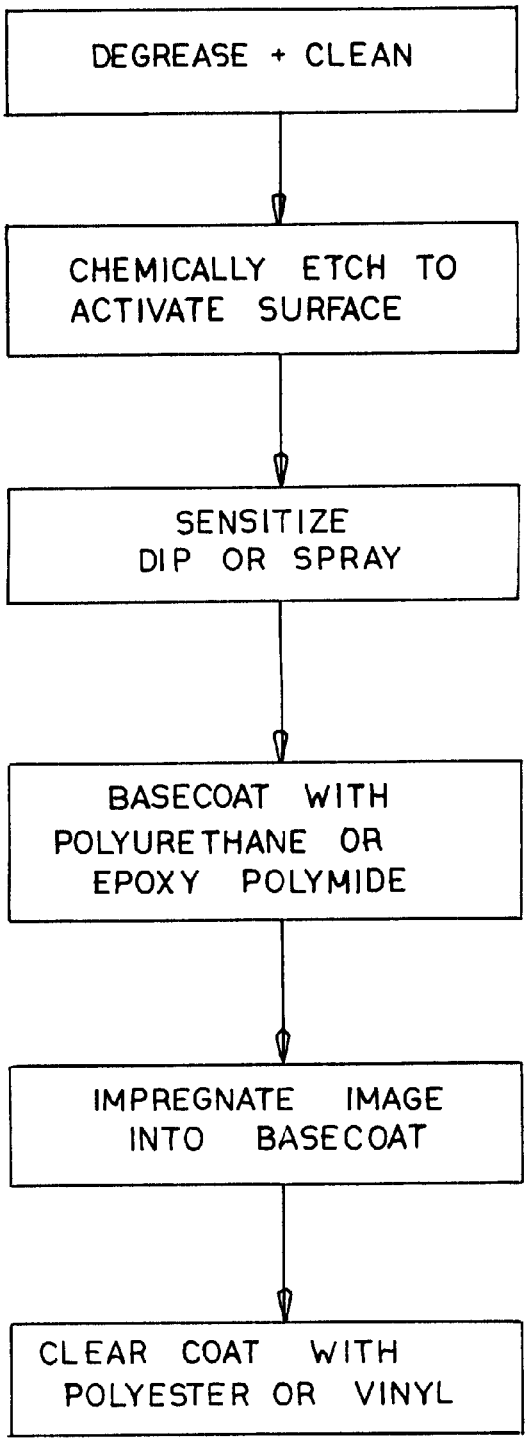
FIG. 5 is a flow diagram of the method for performing the metallic imaging method in accordance with the principles of the present invention.

With reference now to the drawings, and in particular to FIG. 1 thereof, the preferred embodiment of the new and improved metallic imaging system embodying the principles and concepts of the present invention and generally designated by the reference numeral 10 will be described.

The present invention, the metallic imaging system 10 is comprised of a plurality of components. Such components in their broadest context include a housing, a press, a support plate, a transfer sheet, drive mechanisms, heating components, and cooling components. Such components are individually configured and correlated with respect to each other so as to attain the desired objective.

First provided is a housing 14. The housing has an interior chamber 16 with an orifice 18 for withdrawing air and contaminants from the chamber. The housing also has a window 20 for viewing. The housing further has a door 22 for introducing metallic objects 24 into the chamber for receiving printed matter and for removing such objects from the chamber after printing.

Next provided is a press 28. The press is positioned within the chamber. The press has a base 30 with a horizontal upper surface 32 in a rectangular configuration. The base is fabricated of a rigid material. The base has an upper surface. The upper surface has a plurality of positioning pins 34 which extend upwardly from the corners of the upper surface.

The press also has a raisable platen 38 with a guide 40 for movement of the platen between a raised orientation away from the base for loading and unloading purposes and a horizontal lowered orientation immediately above the base during printing. The platen has a lower surface 42 fabricated of a resilient material which is conformable to metal objects to receive printing when located between the upper surface of the base and the lower surface of the platen.

Next provided is a rigid support plate 46. The rigid support plate is in a rectangular configuration and is positionable on the upper surface of the base. The support plate has apertures 50 in corners thereof for removable coupling with the pins upon the base. The support plate has recesses 52 formed therein for the receipt of a plurality of objects to receive printing thereon.

It is preferred that the height of the object to receive an image is greater than the depth of the recess in the platen. This allows the sides of the object to be exposed whereby the image will be transferred to, not only the upper surface of the object, but also onto the sides thereof. It should also be understood that in the preferred embodiment the object to receive the image is flat with planar upper and lower surfaces. The present invention is equally suitable for printing onto objects which are not flat with planar surfaces. When printing onto contoured objects, the recesses in the platen are appropriately configured for receiving and supporting the objects and, similarly, the surface of the platen is likewise configured to conform with the objects to receive the images.

A flexible rectangular transfer sheet 56 is next provided. The transfer sheet has apertures 58 in corners thereof for removable coupling with the pins of the base. The transfer sheet has multicolor printing material 60 in image configuration positioned upon the objects to receive the printing material.

Next provided are drive mechanisms 64. The drive mechanisms function to urge the platen downwardly into contact with the transfer sheet with the objects, plate and base there beneath to effect the transfer of printing material from the transfer sheet to the objects.

Heating components 68 are located within the platen. The heating components function to generate heat sufficient to facilitate the complete transfer of transfer material from the transfer sheet to the objects.

Additionally provided are cooling components 70. The cooling components are located within the base for the rapid lowering of temperature of the objects after the transfer of images.

Lastly provided is a spray booth 74 for applying a final coating to the objects after they have received imaging thereon. In the preferred embodiment, the application is done through a spray gun 76 in an essentially conventional manner.

The present invention also includes a multicolor three-dimensional metallic imaging process. In the process, three dimensional, multi-color images are permanently affixed to a metallic surface and substrate in which it is then covered by a wear resistant, inert and organic coating which fuses and is bonded to the substrate material, producing photo quality and visually pleasing and precise image. The method steps include:

1) Providing a metal substrate, i.e., Aluminum, steels, brassy bronze, copper, nickel, etc., etc.

2) Degreasing the materials to remove all soils, oils, dirt, and foreign materials.

3) Chemically etching, rinsing and drying the metal substrates.

4) Sensitizing the Metal substrates with (Trade secret) specially prepared solution, which may be applied by dipping, spraying, or brushing.

5) Coating the sensitized metallic substrate with a mixture of alcohol and a food grade epoxy or polyurethane material, (clear or colored), and allowing the coated surface to dry cure.

6) Baking the sensitized and coated metallic surface to a full cure by means of a heating source, which may be of UV, Infrared, Convection, or Induction method for a specified time and temperature cycle.

7) Positioning the sensitized and coated substrate into an electromagnetic or vacuum operated jig for accuracy and positive positioning.

8) Applying a multi-colored printed ink image directly to the coated substrate and holding under pressure for a predetermined duration and temperature cycle. This step is performed within a vacuum chamber @ 26 to 28 in.hg.

9) The ink when heated is transformed from a solid to a gaseous state. It fuses into the sensitized coating where the clarity and the precision of the image is enhanced by the vacuum which-allows the gaseous ink to transfer uniformly and without distortion caused by normal ambient conditions commonly applied.

10) The polymers within the inks and the organic coatings are fused together under heat, pressure and vacuum resulting in and forming a chemical reaction which results in a newly formed copolymer compound material.

11) Rapidly cooling the vacuum chamber to remove the heat from the surface of the coated metallic substrate material and relieving the pressure so as to prevent the inks from running, bleeding and blurring the fused images. This is important to keep the clarity of the image intact.

12) Covering the metallic substrate, that has had the multi-colored, 3-dimensional image fused into the coating, with a powdered clear polyester polymer by means of an electrical direct voltage current and melting the substrate within an oven. The melted polyester polymer encapsulates the imaged metallic substrate creating a crystal clear, protective exterior coating resistant to wear, abrasion, chemicals, UV light, corrosion, thermal degradation and fading.

This process employs a method of providing a more precise, detailed, and permanent imagery on a metallic surface as an aid to visually enhance novelty items, tools, instruments, automotive, medical, industrial, and commercial devices where such clarity and permanency have previously been unattainable.

The metallic sensitizing forumla, a sublimated metallic fused imagery, comprises one or more of the following materials in various combinations and percentage quantities:

a) Butyl cellosolve—5%
b) Benzene—2.5%
c) *Butyl alcohol—5%
d) Isopropanol—50%
e) Butyl acrylate—1%
f) P-aminophenol—2%
g) Aluminum oleate—5%
h) Aluminum ethoxide—6.5%
i) Albumen—10%
j) Ferric chloride—0.5%
k) Distilled water—20%
l) Sodium hydroxide—0.5%
m) Dye, powdered, oil blue A—1%
n) *Ethanol Items marked (*) may be substituted for one or the other.

Dependent upon the physical properties of the specific substrates, a variety of different acid wash solutions will be necessary and will be tailed to each type of metal. These solutions are as follows:

a) For aluminum alloys, cast or wrought—10% Nitric Acid & Ammonium-Biflouride, with De-ionized or Distilled Water.

b) For Ferrous Iron and Steel alloys, cast or wrought 15% Hydrochloric Acid and De-ionized or Distilled Water.

c) For Zinc Die alloys, castings—15% Sulfuric Acid/15% Chromic Acid and De-ionized or Distilled Water.

d) For Lead, Tin, Bismuth, or Antimony alloys—15% Fluoboric Acid & 6 oz. per Gl. Of Sodium dichromate and De-ionized or Distilled Water.

e) For Nickel or Nickel-Silver alloys—15% Phosphoric Acid and De-ionized or Distilled Water.

f) For Stainless Steel, cast or wrought, any 300 series alloys—50% Citric or 50% Nitric Acid and De-ionized or Distilled Water.

g) For Copper, Bronze, or Brass cast or wrought alloys—15% Sulfuric Acid and 5 oz. Per Gl. Sodium Dichromate and De-ionized or Distilled Water.

All percentages are calculated as by volume and not by weight. These solutions work best when heated from ambient to 160 degrees F. Use appropriate containers and materials. Take appropriate safety measures when handling these materials and never add water into an acid.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A metallic imaging system for permanently affixing a multicolor image to a metallic surface comprising, in combination:

a housing having an interior chamber with an orifice for withdrawing air and contaminants from the chamber and with a window for viewing and a door for introducing metallic objects into the chamber for receiving printed matter and for removing such objects from the chamber after printing;

a press positioned within the chamber, the press having a base with a horizontal upper surface in a rectangular configuration and fabricated of a rigid material, the upper surface having a plurality of positioning pins extending upwardly from corners thereof;

the press also having a raisable platen with a guide for movement of the platen between a raised orientation away from the base for loading and unloading purposes and a horizontal lowered orientation immediately above the base during printing, the platen having a lower surface fabricated of a resilient material which is conformable to metal objects to receive printing when located between the upper surface of the base and the lower surface of the platen;

a rigid support plate in a rectangular configuration positionable on the upper surface of the base and having apertures in corners thereof for removable coupling with the pins upon the base, the support plate having recesses formed therein for the receipt of a plurality of objects to receive printing thereon;

a flexible rectangular transfer sheet having apertures in corners thereof for removable coupling with the pins of the base, the transfer sheet having multicolor printing material in image configuration positioned upon the objects to receive the printing material;

drive mechanisms to urge the platen downwardly into contact with the transfer sheet with the objects, plate and base there beneath to effect the transfer of printing material from the transfer sheet to the objects;

heating components located within the platen for the generation of heat sufficient to facilitate the complete transfer of transfer material from the transfer sheet to the objects; and cooling components located within the base for the rapid lowering of temperature of the objects after the transfer of images.

2. An imaging system comprising:

a housing having an interior chamber and a door;

a press positioned within the chamber having a base with an upper surface and fabricated of a rigid material, the press also having a raisable platen having a lower surface fabricated of a resilient material;

a support plate positionable on the upper surface of the base for the receipt of an object;

a transfer sheet having printing material positioned upon the object;

drive mechanisms to urge the platen downwardly into contact with the transfer sheet with the object, plate and base there beneath;

heating components located within the platen for the generation of heat; and cooling components located within the base for the lowering of the temperature of the object after the transfer of images.

* * * * *